US006045187A

United States Patent [19]

Stumpf

[11] Patent Number: 6,045,187

[45] Date of Patent: Apr. 4, 2000

[54] CHAIR SEAT HEIGHT ADJUSTMENT MECHANISM

[75] Inventor: William S. Stumpf, Waterloo, Canada

[73] Assignee: Northfield Metal Products Ltd., Waterloo, Canada

[21] Appl. No.: 09/075,114

[22] Filed: May 8, 1998

[51] Int. Cl.[7] ..... A47C 1/02

[52] U.S. Cl. ..... 297/344.19; 297/300.3; 297/302.2

[58] Field of Search ..... 297/300.3, 301.2, 297/302.2, 344.16, 344.19; 16/389; 248/157, 161, 404

[56] References Cited

U.S. PATENT DOCUMENTS

| | | | |
|---|---|---|---|
| 3,439,377 | 4/1969 | Bucholz | 16/389 |
| 4,756,502 | 7/1988 | Egan | 297/344.16 X |
| 5,029,822 | 7/1991 | Selzer | 297/301.2 X |
| 5,355,559 | 10/1994 | Bowers et al. | 16/389 |
| 5,577,804 | 11/1996 | Tedesco | 297/344.19 |
| 5,636,899 | 6/1997 | Schiff et al. | 297/344.19 X |
| 5,829,733 | 11/1998 | Becker | 248/404 X |

OTHER PUBLICATIONS

"Systemseating Chair Control Assemblies" Service Parts Catalog, Catalyst and Systemseating, Jul. 1992, Haworth.

*Primary Examiner*—Peter R. Brown
*Attorney, Agent, or Firm*—Wood, Herron & Evans, LLP

[57] ABSTRACT

A chair height adjustment mechanism which can be retrofit to a chair comprises a rod with a circumferential notch proximate one end for insertion through openings in the chair seat support bracket above a valve opening member of the chair height adjustment cylinder such that the rod is free to tilt against the valve opening member. The circumferential notch receives the looped end of the inner wire of a co-axial cable. The sheath of the cable is supported by a flange of a support member. The support member has an opening which receives the adjustment cylinder and a wheel which redirects the inner wire from the rod toward the flange. The other end of the co-axial cable terminates in a user actuator which may be mounted to the underside of the chair seat.

11 Claims, 5 Drawing Sheets

CHAIR SEAT HEIGHT ADJUSTMENT MECHANISM

BACKGROUND OF THE INVENTION

This invention relates to a height adjustment mechanism for a chair and to a method for retrofitting a chair with such a height adjustment mechanism.

The seat of an office chair is typically supported on a gas cylinder having two-chambers separated by a normally closed valve. Such a gas cylinder generally terminates in a valve opening member at its top end, which valve opening member is biased to an extended position whereat the valve is closed. A user actuator is supplied to depress the valve opening member in order to open the cylinder valve to permit height adjustment of the seat. A known user actuator comprises a rod which terminates in a paddle tiltably mounted in a housing above the valve opening member. With such an actuator, the user may depress the valve opening member by raising the paddle. Such an actuator may be unsightly and awkward to reach.

U.S. Pat. No. 5,577,804 to Tedesco describes a height adjustment mechanism with a lever arm pivotably mounted to a housing above the valve opening member and a support arm rigidly extending below the lever arm. A co-axial cable has its inner wire attached to the lever arm and its outer sheath supported by the support arm. The other end of the cable terminates in a button which may be mounted under the seat or to the chair armrest. By pressing the button, the user may adjust the seat height. While this arrangement avoids problems attendant with a paddle actuator, it still leaves many existing chairs with such actuators.

This invention seeks to overcome drawbacks of existing chair height adjustment mechanisms.

SUMMARY OF THE INVENTION

The subject invention provides a height adjustment mechanism which may be retrofit to existing chairs with paddle actuated height adjustment mechanisms.

According to the present invention, there is provided a height adjustment mechanism for a chair comprising: a rod for tiltable mounting proximate a valve opening member of a height adjusting cylinder, said rod having a notch proximate one end; a co-axial cable having an inner wire with a looped end for reception by said notch; and a user actuator for pulling said inner wire to tilt said rod and a support member having (I) a first leg with an abutment for supporting an outer sheath of said co-axial cable, an opening for receiving said inner wire, and an elongate slot for receiving said tiltable rod, said elongate slot for permitting tilting of said rod to depress said valve opening member and (ii) a second leg at substantially a right angle to said first leg, said second leg having an opening for receiving said height adjusting cylinder.

According to another aspect of the present invention, there is provided a height adjustment mechanism for a chair comprising: a rod for tiltable mounting proximate a valve opening member of a height adjusting cylinder, said rod having a wire receptor proximate one end; a co-axial cable having an inner wire with an end for reception by said wire receptor; a support member having a first leg with an abutment for supporting an outer sheath of said co-axial cable and an opening through which said inner wire may pass and a second leg having an opening for receiving said height adjusting cylinder; and a user actuator for pulling said inner wire to tilt said rod and a redirecting member defining a redirecting channel for receiving said wire, said redirecting member extending from said first leg and arranged such that, proximate said rod, a tangent from said channel extends in a tilting direction of said rod.

According to yet a further aspect of the present invention, there is provided a method for retrofitting a height adjustment mechanism of the type having a bracket with a pair of sidewalls with openings for receiving a rod terminating in a handle, one of said openings comprising an elongate slot permitting tilting of said rod about a fulcrum defined by another of said openings so as to depress a valve opening member of a height adjusting cylinder, comprising the steps of: removing said rod with handle from said openings; lifting said bracket off said height adjusting cylinder and placing a support member on said cylinder such that an opening of said support member receives said cylinder; inserting a rod with a wire receptor proximate one end through said openings such that said wire receptor end of said rod is proximate said elongate slot opening; replacing said bracket on said height adjusting cylinder; supporting an outer sheath of a co-axial cable on an abutment of said support member; threading an inner wire of said co-axial cable through an opening in said support member; joining a wire to said wire receptor, said wire having a user actuator for pulling said wire.

According to a further aspect of this invention, there is provided a support member for a chair height adjustment mechanism, comprising: a leg having an elongate slot for receiving an operative end of a tiltable gas cylinder actuator, a spaced abutment for supporting an outer sheath of a co-axial cable, and an opening positioned with respect to said abutment so as to be able to receive an inner wire of said co-axial cable; and a wheel rotatably mounted to said leg, said wheel having a circumferential groove for receiving said inner wire, said wheel positioned between said opening and said elongate slot such that when an inner wire extends through said opening, about said circumferential groove of said wheel, and is joined to said operative end of said actuator, said inner wire extends between said actuator and said wheel, in a direction of a length of said elongate slot.

BRIEF DESCRIPTION OF THE DRAWINGS

In the figures which disclose an example embodiment of the invention.

DETAILED DESCRIPTION OF THE PREFERRED EMBODIMENTS

Figure 1:
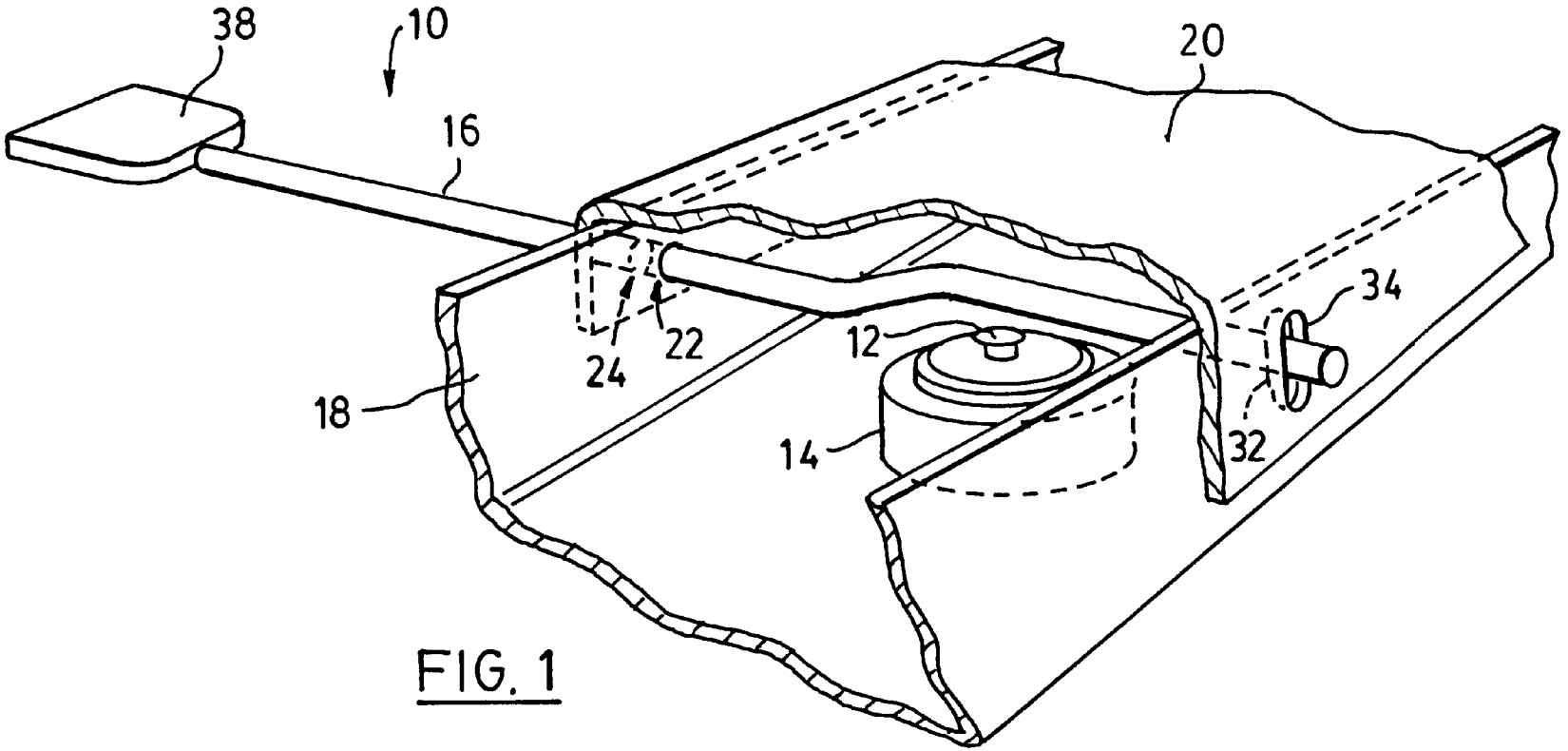
FIG. 1 is a perspective view of a prior art paddle actuated height adjustment mechanism.

Turning first to FIG. 1, a known chair height adjustment mechanism indicated generally at 10 is provided to depress the valve opening member 12 of gas cylinder 14 extending from the base of the chair. The chair height adjustment mechanism comprises a rod 16 which passes through brackets 18 and 20 (bracket 20 is shown as two fragmentary pieces) above the valve opening member 12. As is conventional, bracket 18 is supported on the end of the gas cylinder 14 and bracket 20 is attached to the seat and the two are joined by a pivot pin (not shown) to allow tilting of the seat. Openings 22, 24 through one side wall of each of the brackets 18, 20, respectively is sized to accommodate the rod with a fairly close tolerance. The rod is provided with protuberances 26 which maintain it axially in place in the openings 22, 24 of the brackets. The rod is received through a vertical slot 32, 34 in the other side wall of each of the brackets 18, 20, respectively, which allows the end 36 of the rod to tilt downwardly. Rod 16 terminates in paddle 38. In operation, a user may grasp paddle 36 and raise it in order to tilt the rod downwardly about a fulcrum defined by openings 22, 24 to depress the valve opening member. The user may then adjust the height of the chair as desired and release the paddle when the desired height is reached resulting in the valve opening member returning to its extended, valve-closed, position.

Turning now to FIGS. 2 through 6 wherein like parts to those illustrated in FIG. 1 have been given like reference numerals, a chair height adjustment mechanism illustrated generally at 100 comprises a rod 116 passing through openings 22, 24 and vertical slots 32, 34 of brackets 18 and 20, respectively, above the valve opening member 12 of gas cylinder 14. As is conventional, bracket 20 has flanges 21 for attachment to the seat of the chair and these two brackets 18, 20 are joined by a pivot pin 23 which allows tilting of the chair seat against the biasing pressure of an adjustable spring. Openings 22, 24 through one side wall of each of the brackets are sized to accommodate the rod with a fairly close tolerance. The rod is provided with protuberances 26 which maintain it axially in place in the openings 22, 24 of the brackets. The rod is received through vertical slots 32, 34 in the other side walls of the brackets which allow the end 36 of the rod to tilt downwardly. The rod has a circumferential notch 140 proximate its end 142. Referencing specifically FIG. 3, the rod 116 has a flat area 128 for contacting the valve opening member 12.

Figure 2:
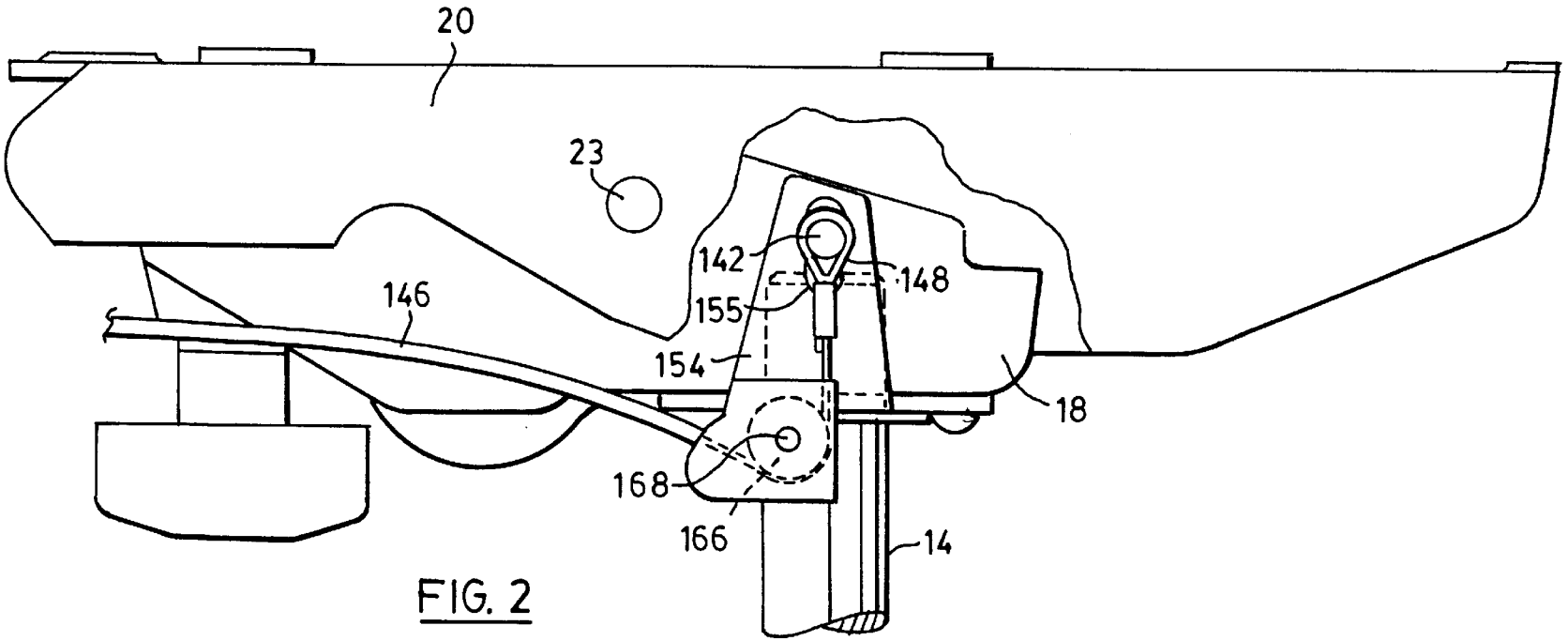
FIG. 2 is a side view of a portion of a height adjustment mechanism made in accordance with this invention.
Figure 3:
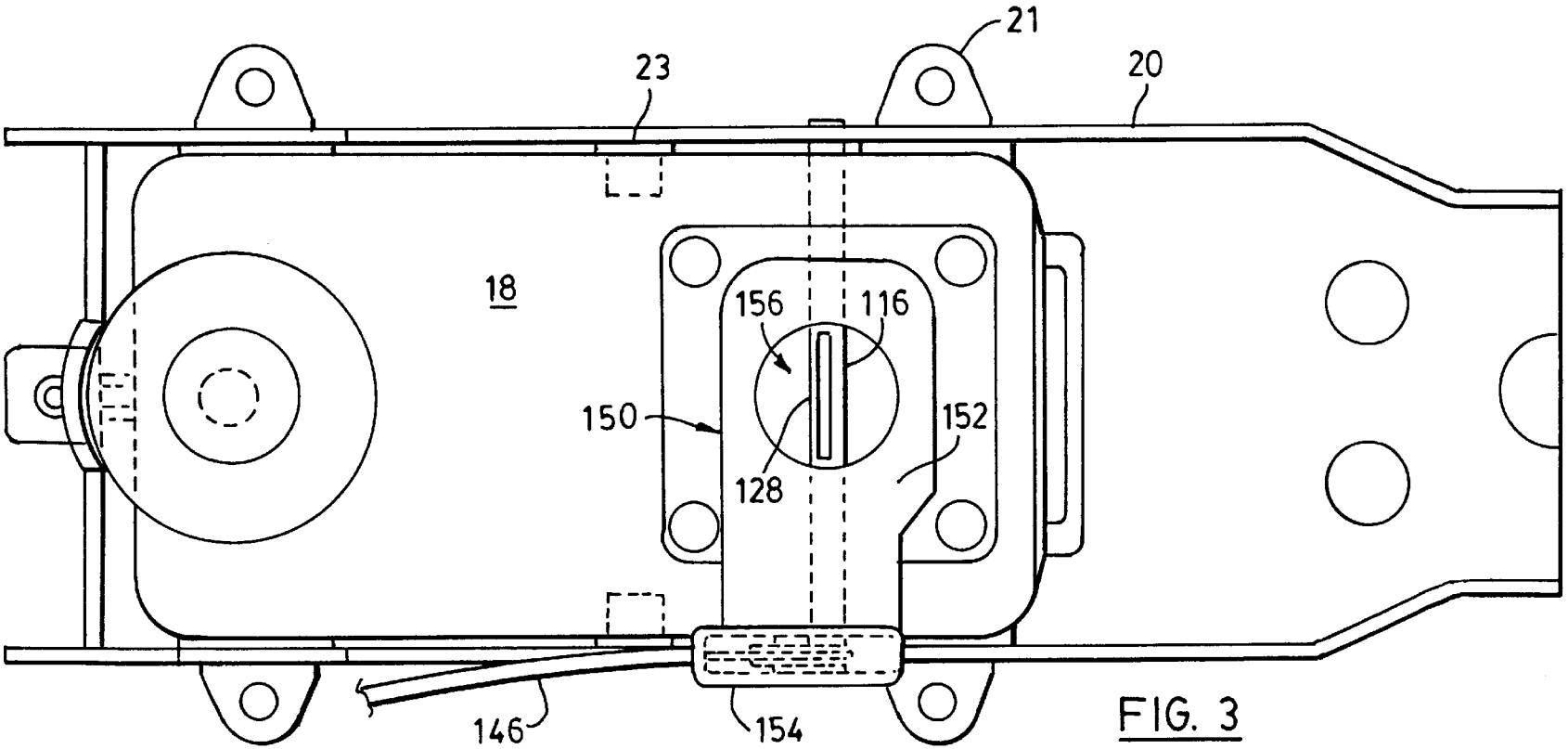
FIG. 3 is a bottom view of FIG. 2 absent a height adjusting cylinder.
Figure 4:
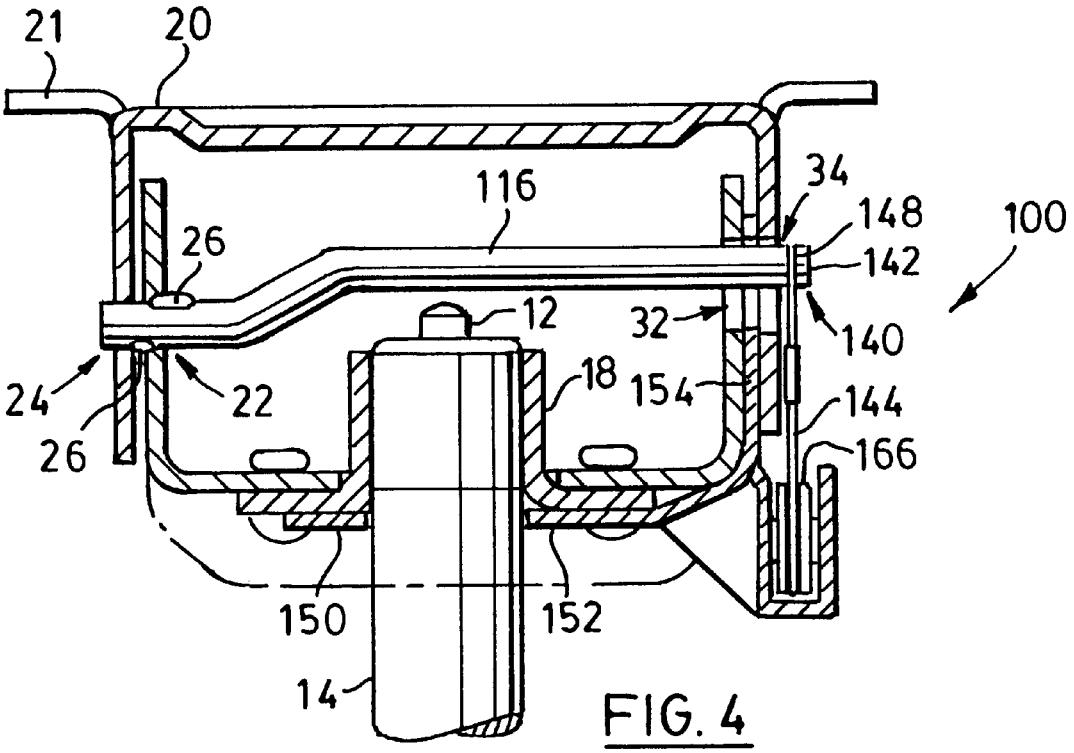
FIG. 4 is a cross-sectional view along the lines IV—IV of FIG. 2.
Figure 5:
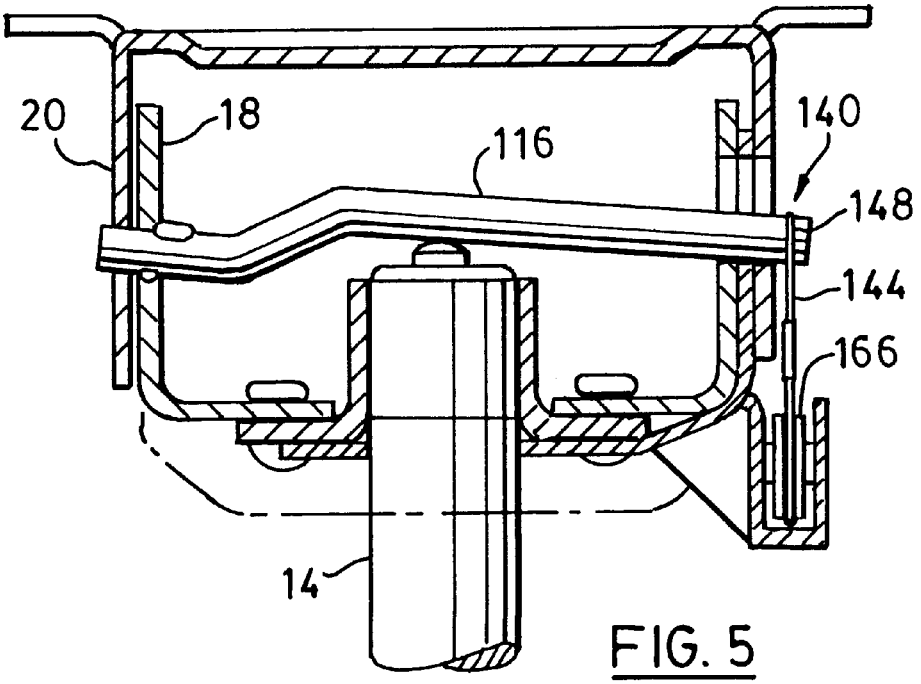
FIG. 5 is a similar view to that of FIG. 4 but illustrating the chair adjustment mechanism in an adjustment position.
Figure 6:
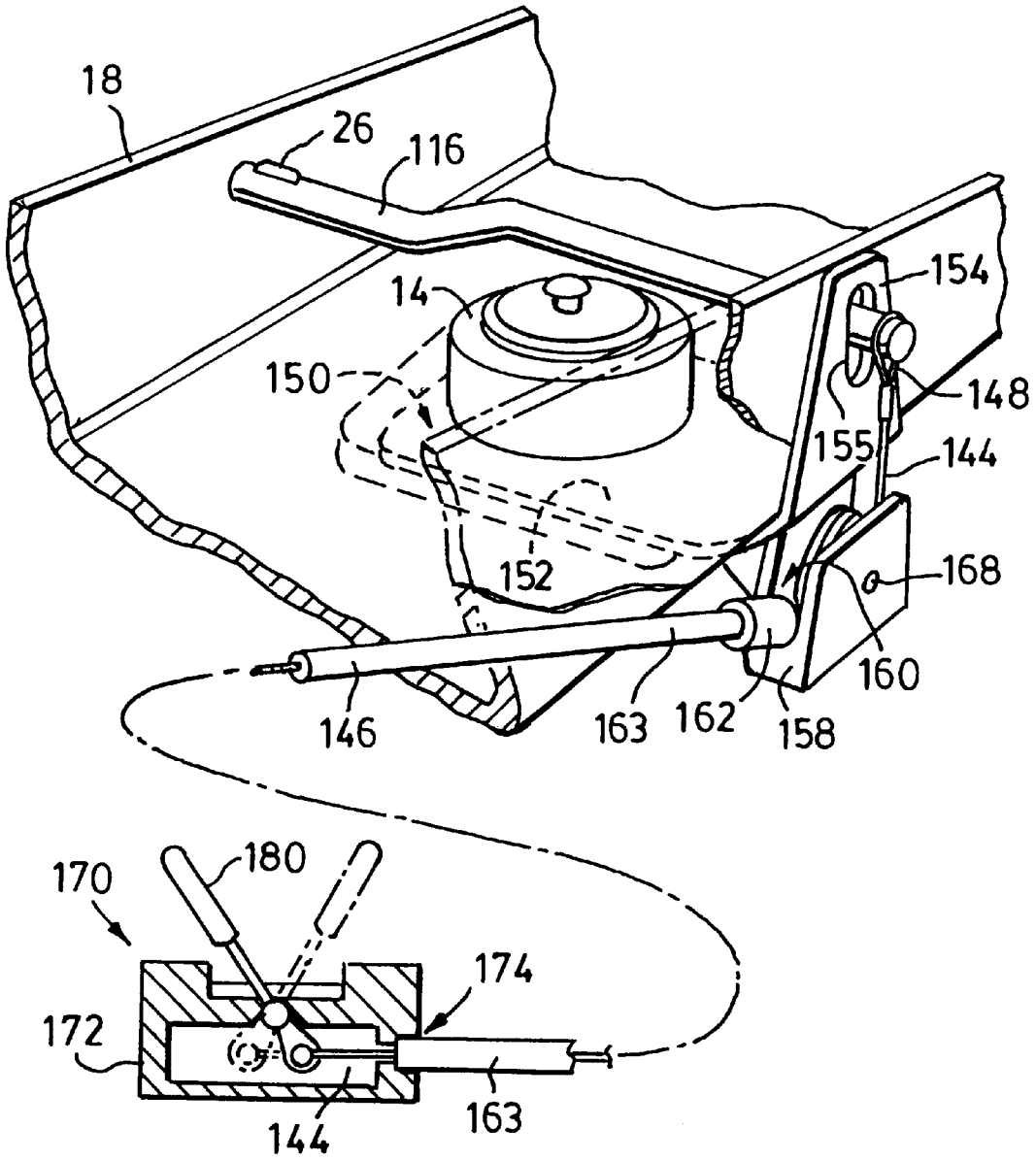
FIG. 6 is a partially sectioned perspective view of a height adjustment mechanism made in accordance with this invention.

The height adjustment mechanism also comprises a co-axial cable 146 and a support member 150. The co-axial cable has an inner wire 144 with a looped end 148 received by circumferential notch 140 of rod 116. The support member has a support leg 152 at a right angle to a flanged leg 154. The support leg 152 has an opening 156 (FIG. 3) for receiving the height adjusting cylinder 14. The flanged leg 154 extends upwardly between brackets 18 and 20 and has a vertical slot 155 receiving rod 116. As best seen in FIG. 6, a flange 158 of the flanged leg has a notched opening 160. The co-axial cable 146 extends through the notched opening 160 and an enlargement 162 attached to the sheath 163 of the cable forms a shoulder which abuts the flange so that the sheath is supported by the flange. A rotatable wheel 166 supported on a pin 168 of the flanged leg has a circumferential groove which receives the inner wire 144 of the co-axial cable. As best seen in FIG. 2, the wheel is preferably positioned so that a vertical tangent from the wheel intersects the rod. The groove in the wheel therefore acts as a redirecting channel for the inner wire redirecting it from a vertical orientation between the rod and wheel to an inclined orientation between the wheel and flange 158.

Referencing FIG. 6, the co-axial cable 146 terminates at its free end in a user actuator 170. The user actuator comprises a housing 172 with a shouldered opening 174. The sheath 163 of the cable abuts the shoulder of the opening and the inner wire 144 of the cable passes through the opening. The inner wire is attached to end of a lever 180. The user actuator may conveniently be attached under the seat of the chair.

In operation, a user may pull lever 180 from the solid line position indicated in FIG. 6 to the position indicated in phantom in FIG. 6. This pulls the inner wire 144 of the co-axial cable so that the wire tilts rod 116 downwardly thereby depressing valve opening member 12 to permit height adjustment of the chair. It will be appreciated that the reaction force of the sheath 163 when wire 144 is pulled is resisted by flange 158 of the support member 150.

The chair adjustment mechanism of this invention is suited to retrofitting to an existing chair having the mechanism illustrated in FIG. 1. To retrofit a FIG. 1 chair, the chair seat is lifted off of the supporting height adjustment cylinder 14. The rod 16 is then removed from the two brackets 18, 20. This may be facilitated by first removing (or cutting) the paddle from the rod. Next, referencing FIGS. 2 to 6, rod 116 is inserted into the bracket openings 22, 24, 32, 34 such that the notched end 142 of the rod is proximate the vertical slot openings 32, 34 of the brackets and the protuberances 26 restrict axial sliding of the rod. Support member 150 is then positioned in place and the looped end 148 of inner wire 144 of cable 146 threaded through notched opening 160 of flange 158 and around wheel 146 to rod 116. The loop is then pushed into the notch of the rod and the sheath of the cable positioned so that the shoulder between the enlargement 162 and the sheath 163 abuts the flange 158 of the support member. The housing 172 of the user actuator 170 is affixed under the seat of the chair and the seat reseated on the gas cylinder 14 such that the cylinder is received by opening 156 in the support member.

From the foregoing, it will be apparent that no bolts or other forms of attachment are needed to join the support member 150 to the bracket 18 or 20. Instead, the support member is laterally constrained by opening 156 in its leg 152 receiving cylinder 14 and is vertically constrained by the attachment of the inner wire of the cable to rod 116. This may result in the support member "drooping" to a small extent in the rest position whereat the rod has not been tilted to depress the valve opening member. However, this has no negative effect on the operation of the chair height adjustment mechanism.

A number of modifications will be apparent. For example, the flanged leg 154 of the support member 150 may have a wall defining a wire redirecting curved channel in place of wheel 166. Rod 116 acts as a lever arm and, therefore, may have any configuration suitable for this purpose (e.g., it could have a generally rectangular cross-section). The rod 116 could be formed with a wire receptor other than the described circumferential notch 140. For example, the rod could be provided with a key hole opening proximate end 142 in place of the circumferential notch. This key hole opening would comprise a narrow radial slot extending into a countersunk enlarged well. In this case, the inner wire 144 of cable 146 would terminate in a ball. The wire would then be joined to the rod by sliding same into the narrow radial slot until the ball slipped into the countersunk well. While the user actuator 170 has been described as comprising a lever, it could equally comprise any other user actuator, such as a button in conjunction with a lever such that the wire 144 was pulled when the button was pushed.

Other modifications will be apparent to those skilled in the art and, therefore, the invention is defined in the claims.

What is claimed is:

1. A height adjustment mechanism for a chair comprising:

a rod for tiltable mounting proximate a valve opening member of a height adjusting cylinder, said rod having a notch proximate one end;

a co-axial cable having an inner wire with a looped end for reception by said notch;

a user actuator for pulling said inner wire to tilt said rod; and a support member having (I) a first leg with an abutment for supporting an outer sheath of said co-axial cable, an opening for receiving said inner wire, and an elongate slot for receiving said tiltable rod, said elongate slot for permitting tilting of said rod to depress said valve opening member and (ii) a second leg at substantially a right angle to said first leg, said second leg having an opening for receiving said height adjusting cylinder.

2. The mechanism of claim 1 wherein said support member comprises a redirecting member defining a redirecting channel for receiving said wire, said redirecting member extending from said first leg and arranged such that, proximate said elongate slot, a tangent from said channel extends in a direction of a length of said elongate slot.

3. The mechanism of claim 1 wherein said redirecting member comprises a circumferentially grooved wheel rotably mounted to said first leg.

4. A height adjustment mechanism for a chair comprising:

a rod for tiltable mounting proximate a valve opening member of a height adjusting cylinder, said rod having a wire receptor proximate one end;

a co-axial cable having an inner wire with an end for reception by said wire receptor;

a support member having a first leg with an abutment for supporting an outer sheath of said co-axial cable and an opening through which said inner wire may pass and a second leg having an opening for receiving said height adjusting cylinder;

a user actuator for pulling said inner wire to tilt said rod; and a redirecting member defining a redirecting channel for receiving said wire, said redirecting member extending from said first leg and arranged such that, proximate said rod a tangent from said channel extends in a tilting direction of said rod.

5. The mechanism of claim 4 wherein said redirecting member comprises a wheel rotatably mounted to said second leg, said wheel having a circumferential groove.

6. The mechanism of claim 5 wherein said first leg has an elongate slot for receiving said tiltable rod, said elongate slot for permitting tilting of said rod to depress said valve opening member.

7. The mechanism of claim 4 wherein said wire receptor comprises a circumferential notch in said rod.

8. A method for retrofitting a height adjustment mechanism of the type having a bracket with a pair of sidewalls with openings receiving a rod terminating in a handle, one of said openings comprising an elongate slot permitting tilting of said rod about a fulcrum defined by another of said openings so as to depress a valve opening member of a height adjusting cylinder, comprising the steps of:

removing said rod with handle from said openings;

lifting said bracket off said height adjusting cylinder and placing a support member on said cylinder such that an opening of said support member receives said cylinder;

inserting a rod with a wire receptor proximate one end through said openings such that said wire receptor end of said rod is proximate said elongate slot opening;

replacing said bracket on said height adjusting cylinder;

supporting an outer sheath of a co-axial cable on an abutment of said support member;

threading an inner wire of said co-axial cable through an opening in said support member;

joining said inner wire to said wire receptor, said inner wire having a user actuator for pulling said inner wire.

9. The method of claim 8 wherein said support member supports a redirecting wheel and including the step of winding said wire about a portion of a circumference of said wheel after threading said inner wire through said wire receiving opening and prior to joining said wire to said wire receptor.

10. The method of claim 8 wherein said support member wherein said support member supports a redirecting member defining a redirecting channel for receiving said inner wire and including the step of winding said wire about a portion of said redirecting channel after threading said inner wire through said wire receiving opening and prior to joining said wire to said wire receptor.

11. A support member for a chair height adjustment mechanism, comprising:

a leg having an elongate slot for receiving an operative end of a tiltable gas cylinder actuator, a spaced abutment for supporting an outer sheath of a co-axial cable, and an opening positioned with respect to said abutment so as to be able to receive an inner wire of said co-axial cable; and a wheel rotatably mounted to said leg, said wheel having a circumferential groove for receiving said inner wire, said wheel positioned between said opening and said elongate slot such that when an inner wire extends through said opening, about said circumferential groove of said wheel, and is joined to said operative end of said actuator, said inner wire extends between said actuator and said wheel, in a direction of a length of said elongate slot.

* * * * *